US007837067B2

(12) United States Patent
Amron

(10) Patent No.: US 7,837,067 B2
(45) **Date of Patent: *Nov. 23, 2010**

(54) WATER GUN AMUSEMENT DEVICES AND METHODS OF USING THE SAME

(75) Inventor: Alan B. Amron, Brooklyn, NY (US)

(73) Assignee: Though Development, Inc., Miami Beach, FL (US)

( * ) Notice: Subject to any disclaimer, the term of this patent is extended or adjusted under 35 U.S.C. 154(b) by 650 days.

This patent is subject to a terminal disclaimer.

(21) Appl. No.: 11/271,613

(22) Filed: Nov. 12, 2005

(65) Prior Publication Data

US 2006/0273199 A1 Dec. 7, 2006

Related U.S. Application Data

(63) Continuation-in-part of application No. 11/136,693, filed on May 23, 2005, now Pat. No. 7,458,485.

(51) Int. Cl.
*A63H 3/18* (2006.01)

(52) U.S. Cl. ..... 222/79; 239/333; 239/373; 239/463

(58) Field of Classification Search ..... 222/79, 222/333; 239/443, 446, 302, 373, 486, 463
See application file for complete search history.

(56) References Cited

U.S. PATENT DOCUMENTS

| | | | |
|---|---|---|---|
| 1,150,940 | A | 8/1915 | Irish |
| 1,798,488 | A | 3/1931 | Orr |
| 1,941,786 | A | 1/1934 | Carley et al. |
| 2,381,740 | A | 8/1945 | Grelson |
| 2,552,716 | A | 5/1951 | Holland |
| 2,564,639 | A | 8/1951 | Cuppett et al. |
| 2,794,292 | A | 6/1957 | Noble |
| 2,830,739 | A | 4/1958 | Moye |
| 2,998,166 | A | 8/1961 | Klawiter |
| 3,399,638 | A | 9/1968 | Bishop et al. |
| 3,493,179 | A | 2/1970 | Lee |

(Continued)

OTHER PUBLICATIONS

Office Action dated Jul. 30, 2010 issued in corresponding U.S. Appl. No. 11/339,738.

(Continued)

*Primary Examiner*—Len Tran
*Assistant Examiner*—Trevor E McGraw
(74) *Attorney, Agent, or Firm*—Cohen Pontani Lieberman & Pavane LLP

(57) ABSTRACT

Toy water guns include a housing supporting a liquid storage reservoir, a conduit for establishing fluid communication between the reservoir and a discharge orifice disposed proximate a front end of the housing, a trigger mechanism, a fluid transfer system adapted to develop forces for causing a continuous or pulsed stream of liquid to flow through the conduit and out of the discharge orifice when the trigger is pressed. An illustrative embodiment employs a nozzle translation assembly that is dimensioned and arranged to move the discharge orifice along a time varying path relative to the housing as a stream of liquid is discharged. The time varying path may be circular, as to obtain a helical or spiral flow pattern or non-circular as to obtain, for example, a zig-zagging or figure eight pattern.

3 Claims, 6 Drawing Sheets

U.S. PATENT DOCUMENTS 3,508,709 A 4/1970 Serbousek
3,556,689 A 1/1971 Heckler, IV
3,804,336 A 4/1974 Koeppe
4,335,677 A 6/1982 Nagata
4,397,879 A 8/1983 Wilson
4,501,391 A 2/1985 Hunter
4,542,853 A 9/1985 Diamond
4,615,488 A 10/1986 Sands
4,709,691 A 12/1987 Lemons et al.
4,744,517 A 5/1988 Iwamoto
4,821,961 A * 4/1989 Shook ..... 239/253
4,842,200 A 6/1989 Hermansson
4,989,786 A * 2/1991 Kranzle et al. ..... 239/240
5,024,382 A 6/1991 Shook et al.
5,060,863 A 10/1991 Hammelmann
5,086,974 A 2/1992 Henshaw
5,104,043 A 4/1992 Pacht
5,224,652 A 7/1993 Kessler
5,244,153 A * 9/1993 Kuhn et al. ..... 239/587.5
5,297,979 A 3/1994 Amron
5,392,968 A 2/1995 Dark
5,395,053 A 3/1995 French
5,427,320 A 6/1995 Mak et al.
5,433,646 A * 7/1995 Tarng ..... 446/473
5,456,413 A 10/1995 Ellis
5,505,380 A 4/1996 Jun
5,577,945 A 11/1996 LaBelle
5,582,532 A 12/1996 Tucker
5,586,688 A * 12/1996 Johnson et al. ..... 222/61
5,595,345 A 1/1997 Chura
5,667,138 A 9/1997 Crampton
5,674,323 A 10/1997 Garcia
5,725,680 A 3/1998 Mathieus
5,826,750 A 10/1998 Johnson
5,865,344 A 2/1999 Nagel
5,878,914 A 3/1999 Johnson
6,007,003 A * 12/1999 Wang ..... 239/525
6,129,293 A 10/2000 Jager
6,138,871 A * 10/2000 D'Andrade ..... 222/79
6,151,824 A 11/2000 Clayton
6,155,494 A 12/2000 Fabbri et al.
6,186,367 B1 2/2001 Harrold
6,196,475 B1 3/2001 Jaeger
6,199,771 B1 3/2001 Clearman et al.
6,247,658 B1 6/2001 Bakas
6,250,506 B1 6/2001 Geiger et al.
6,331,130 B1 12/2001 Thai
6,364,162 B1 4/2002 Johnson
6,422,480 B1 7/2002 Richmond
6,474,507 B1 * 11/2002 Hornsby et al. ..... 222/79
6,540,108 B1 4/2003 Johnson
6,594,843 B1 7/2003 Wilkins
6,676,037 B2 1/2004 Marks
6,719,218 B2 4/2004 Cool
6,766,967 B2 7/2004 Harris et al.
6,892,902 B2 5/2005 Hornsby
6,899,286 B2 5/2005 Blessing
6,905,388 B2 6/2005 Schoonmaker
6,935,531 B1 8/2005 Clayton
6,959,838 B2 11/2005 Eddins et al.
7,032,837 B2 4/2006 Eddins et al.
7,097,073 B2 8/2006 Zimmerman
7,111,795 B2 9/2006 Thong
7,131,557 B2 11/2006 Zimmerman et al.
7,175,107 B2 * 2/2007 Amaduzzi ..... 239/251
7,182,477 B1 * 2/2007 Hartz ..... 362/96
7,185,787 B2 3/2007 Brown et al.
7,549,599 B2 * 6/2009 Amron ..... 239/263.2
2001/0019083 A1 9/2001 Marks
2002/0030066 A1 3/2002 McKenna
2002/0090878 A1 7/2002 Holmes
2003/0071141 A1 4/2003 Rieben
2003/0085303 A1 5/2003 Jaeger
2004/0164090 A1 8/2004 Eddins et al.
2005/0035148 A1 * 2/2005 Zimmerman ..... 222/79
2005/0127203 A1 6/2005 DeWitt
2005/0173559 A1 * 8/2005 Eddins et al. ..... 239/302
2006/0065760 A1 3/2006 Micheli
2006/0261087 A1 * 11/2006 Amron ..... 222/79
2006/0261184 A1 * 11/2006 Amron ..... 239/263

OTHER PUBLICATIONS

Office Action dated Apr. 2, 2010 issued in corresponding U.S. Appl. No. 11/339,738.
Office Action dated Jul. 7, 2009 issued in corresponding U.S. Appl. No. 11/339,738.

* cited by examiner

WATER GUN AMUSEMENT DEVICES AND METHODS OF USING THE SAME

REFERENCE TO RELATED APPLICATIONS

This application is a continuation-in-part of U.S. patent application Ser. No. 11/136,693, entitled WATER GUN AMUSEMENT DEVICES AND METHODS OF USING THE SAME, filed on May 23, 2005 now U.S. Pat. No. 7,458,485.

FIELD OF THE INVENTION

The present invention relates generally to toy water guns and, more particularly, to toy water guns operative, in accordance with at least one mode of operation, to discharge water in a configuration other than as a continuous, extended stream.

BACKGROUND OF THE INVENTION

Water guns have for decades been a very popular child's toy. The toy industry is very competitive, hundreds of different style water guns have been developed in an attempt to profit from the toy's inherent popularity. The earliest forms of water guns were activated by the pumping action which occurs during the depression of a trigger. Accordingly, the range and volume of water expelled by these water pistols was limited by the throw of the trigger. With the goal of projecting more water faster on the target always in mind, toy water gun designers have introduced a number of significant design enhancements—with many of these enjoying a substantial degree of commercial success.

Pressure differential water guns employing a bladder are exemplified by U.S. Pat. No. 4,854,480 to Robert S. Shindo and U.S. Pat. No. 4,735,239 to Michael E. Salmon et al, which show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder. For so long as water remains in the bladder and the trigger is depressed, water is ejected through the nozzle in an extended, continuous stream for so long as the trigger is depressed.

Since a source of pressurized water is not always available, a number of other methods have been devised to enhance the flow rate and range of streams ejected by toy water guns. In U.S. Pat. No. 4,022,350 entitled WATER GUN and issued to the inventor herein, Alan Amron, on May 20, 1977, there is disclosed a toy water gun that incorporates a battery driven motor and associated pump. By means of reciprocating movement of the pump piston, water is drawn from a reservoir and discharged through a nozzle. The discharge is interrupted by the intake strokes of the piston so that the discharge is accomplished intermittently or in spurts rather than in a continuous stream.

Water guns have also been developed that use air pressure to pressurize water in a reservoir and to force the water through an avenue of release extending from the reservoir to a discharge nozzle. Such toys that use air pumps to pressurize water are exemplified by U.S. Pat. No. 3,163,330 issued to J. W. Ryan on Dec. 29, 1964 and entitled TOY WATER SHOOTING CAP RIFLE, which shows a toy rifle consisting of a pressurized water reservoir, a pump for manually pressurizing the water reservoir, and a valve activated by a trigger to allow the pressurized water to flow toward the nozzle. The water is discharged as a continuous extended stream for as long as the trigger is depressed provided that sufficient air remains in the reservoir to keep the water flowing.

In the past decade, pressurized water guns equipped with a hand operated pump, as taught by Ryan, have enjoyed a considerable degree of commercial success. However, the need to repeatedly operate the pumping mechanism—often twenty five times or more—to achieve adequate air pressurization within the reservoir, has presented a challenge to the impatient user and to smaller children. For this reason, it has been proposed in U.S. Pat. No. 6,234,347 entitled PRESSURIZED WATER GUN WITH SELECTIVE PRESSURIZATION and issued to the inventor herein on May 22, 2001, to give the user an option of selecting one of two different modes of pressurization—manual pressurization using an onboard pump or, when a source of municipally pressurized water is accessible, a one-way valve system designed to admit the already-pressurized water into the reservoir. Regardless of the method used for pressurizing the Amron water gun, depression of the trigger causes water to flow from the reservoir, through an avenue of release, and out the ejection nozzle as a continuous, extended stream.

The development and introduction of various design features over the past six decades have unquestionably yielded toy water guns which have better performance and operating characteristics (e.g., faster flow rates and the ability to discharge streams over longer distances) than the traditional water pistol design. Notably, however, the actual configuration of the toy water gun "output" has remained substantially the same during all that time. That is, while their range and flow rates have increased, toy water guns have heretofore been designed to produce a concentrated, straight stream of water capable, for example, of being aimed at and of striking a discrete point—usually in the shortest distance possible. A need therefore exists for toy water guns capable of discharging water in more innovative and creative ways.

SUMMARY OF THE INVENTION

The aforementioned need is addressed, and an advance is made in the art, by toy water gun devices selectively operable to discharge water in either a pulsed or a continuous stream. The stream may be linear in the manner of conventional water gun devices or, in accordance with various illustrative embodiments of the present invention, can assume a helical, spiral or other arcuate path or, in fact, any path that changes relative to the longitudinal axis of the water gun housing—i.e., without movement of the gun.

A water gun constructed in accordance with a first illustrative embodiment of the present invention adapted to produce pulsed or continuous streams comprises a housing and an extended handle connected to the housing. A barrel portion of the housing defines a longitudinal axis extends outwardly away from the handle. The water gun further comprises a nozzle translation assembly defining a discharge outlet, at least the portion of the nozzle translation assembly defining the discharge outlet being adapted to translate relative to the water gun housing. An avenue of release connects the nozzle translation assembly to the water storage reservoir, and a trigger is located on the housing adjacent the handle. Because the discharge outlet is adapted to translate while the trigger is depressed, the stream of water being discharged through the outlet traverses a time varying path relative to the longitudinal axis of the housing (i.e., the stream moves while the water gun handle, housing, reservoir, etc remain stationary). The stream so discharged traverses a time varying path to thereby form a predefined pattern—i.e., a helical, spiral, criss-cross ("figure eight"), zig-zagging, etc., which is unbroken for so long as water flows through the avenue of release. The duration of this flow, in turn, depends inter alia upon whether the trigger mechanism is operated in accordance with a first or "pulsed" mode or a second, "continuous" mode.

Automatic translation of the discharge outlet to produce a time varying flow path in accordance with the present invention can be achieved in a variety of ways. For a circular path needed to produce a spiral or helical flow pattern, the nozzle translation assembly itself can be implemented as a rotating structure. To that end, a motorized drive assembly responsive to depression of the trigger or, alternatively, to actuation of an on/off selector switch, and drivingly engageable with appropriate gearing on the nozzle translation assembly can be incorporated proximate the front end of the water gun housing. Alternatively, the force for spinning the nozzle translation assembly can be provided via the pressurized water stream traversing the avenue of release. For example, a water turbine assembly can be placed at an appropriate location in the flow path. By way of yet another example, the discharge outlet of the nozzle translation assembly may be dimensioned and arranged to impart a nozzle reaction force—that is offset relative to the axis of nozzle translation assembly rotation—as the stream of water is discharged. Even a relatively small angle of inclination of the discharge stream relative to a plane orthogonal to the rotational axis of the translating nozzle translation assembly is sufficient to induce rotation of the nozzle translation assembly.

Translation of the discharge outlet to form non-circular, time-varying flow paths can also be achieved in a variety of ways. For example, the nozzle translation assembly may include a water- or electrically powered mechanism to move the discharge outlet along a predefined path. By way of illustration, the discharge outlet may be defined as part of a pivoting nozzle structure which, by an appropriate mechanical linkage, is adapted to pivot about a single axis of rotation that transacts a longitudinal axis of the water gun housing. Such a pivoting motion results in what may be characterized as a zig-zag motion. By way of alternative example, the discharge outlet may be defined as part of a universally pivotable nozzle structure that is adapted to pivot in such a way that the discharge outlet follows a predefined course such, for example, as a figure eight, cardiod, ellipsoidal, or other repeatable, closed path.

BRIEF DESCRIPTION OF THE DRAWINGS

The details of the present invention, both as to its construction and operation can best be understood with reference to the accompanying drawings, in which like numerals refer to like parts, and in which.

DETAILED DESCRIPTION OF THE INVENTION

Figure 1:
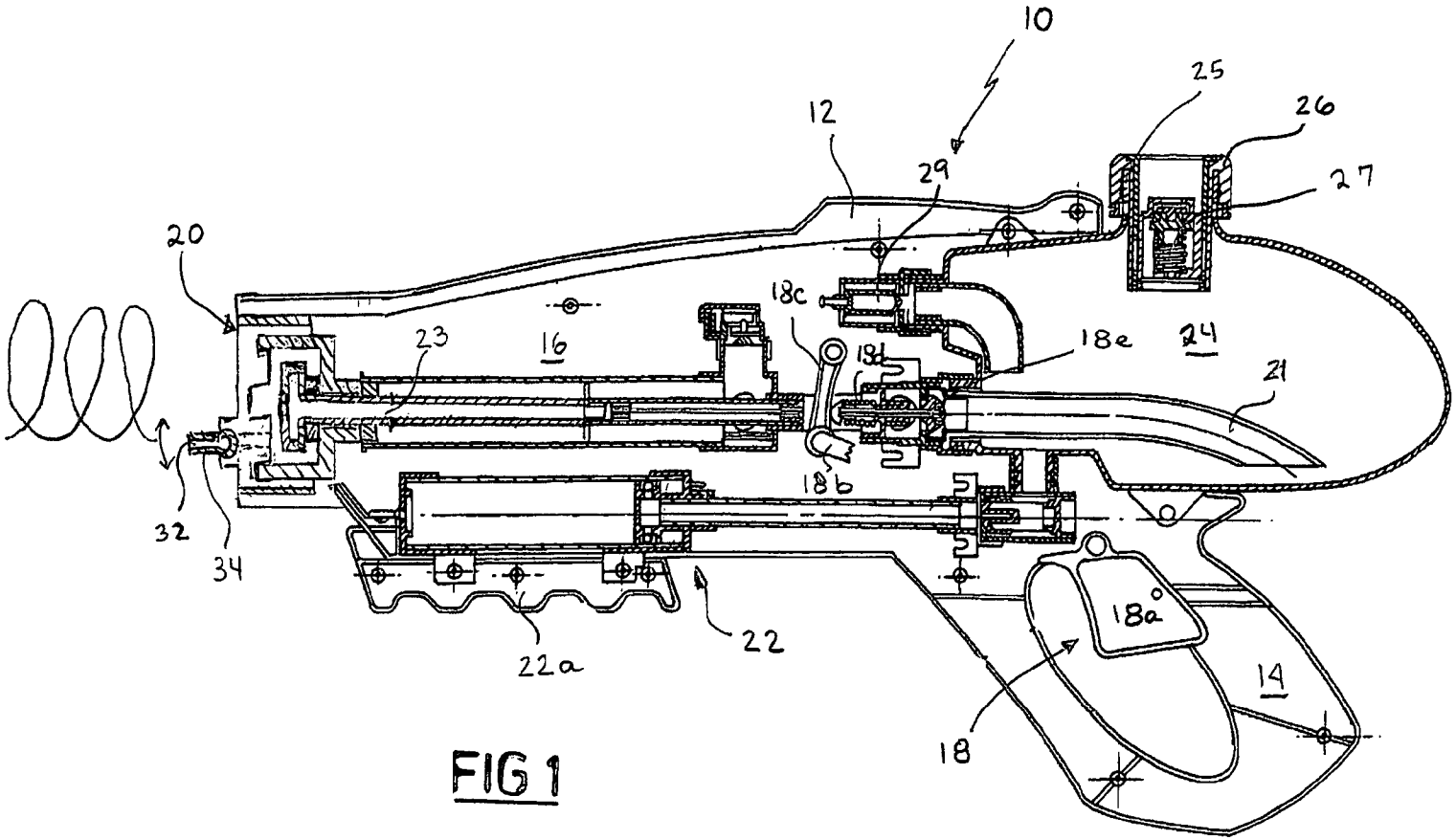
FIG. 1 is a side elevation view, in cross section, depicting a water gun constructed in accordance with a first illustrative embodiment of the present invention, the water gun being equipped with a nozzle translation assembly adapted to rotate automatically, as water is discharged, to produce a continuous or interrupted helical stream.

The accompanying Figures and this description depict and describe embodiments of a water gun amusement device in accordance with the present invention, and features and components thereof. The present invention also encompasses a method of making and using embodiments of the amusement device. As used herein, the phrases or terms "water gun amusement device," "toy gun," "water gun," "squirt gun" and the like are intended to encompass a structure or structures configured to project, throw, squirt, launch or shoot a generally liquid material, such as water or the like, in a manner other than as a continuous stream or a broken stream of repeated, single "shots," bursts, doses or quantities of water or the like. It is important to note, however, that toy water guns constructed in accordance with the present invention can, if an optional mode of operation is desired, be configured to project a continuous or broken stream if the user so selects. It should also be noted that any references herein to front and back, right and left, top and bottom and upper and lower are intended for convenience of description, not to limit the present invention or its components to any one positional or spacial orientation.

With regard to fastening, mounting, attaching or connecting components of the present invention to form the water gun amusement device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. Components may also be connected by adhesives, glues, welding, ultrasonic welding, and friction fitting or deformation, if appropriate, and appropriate liquid and/or airtight seals or sealing devices may be used. Electronic portions of the device may use conventional, commercially available electronic components, connectors and devices such as suitable wiring, connectors, printed circuit boards, microchips, speakers, lights, LED's, liquid crystal displays, pressure sensors, liquid level sensors, audio components, inputs, outputs and the like. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

With regard to the manner in which water is urged to flow toward a discharge orifice upon depression of a trigger or other means, it should be borne in mind that although the various embodiments described herein incorporate an on-board pump for pressurizing a water-containing, fixed-volume chamber with air, the invention is not limited to such configurations. For example, if the delivery of intermittent pulses are desired, a motorized arrangement as, for example, the one described in the aforementioned U.S. Pat. No. 4,022,350 may be used. By way of further example, the water storing chamber may be configured as an expandable bladder dimensioned and arranged to receive and store water from a hose end adapter coupled to a municipally pressurized water source (as in the case of the aforementioned U.S. Pat. Nos. 4,854,480 and 4,735,239 to Shindo and Salmon et al, respectively). By way of still further example, a water gun constructed in accordance with the teachings of the present invention may utilize both a bladder for storing pressurized water and an on-board, manually operated, fluid transfer pump for transferring fluid from an unpressurized water chamber having a fill cap to the bladder. An example of the latter arrangement is disclosed in U.S. Pat. No. 5,875,927 entitled TOY GUN HAVING AN EXPANDABLE TEAR DROP SHAPED BLADDER FOR EJECTION OF LIQUID THEREFROM. It suffices to say that the manner in which water ejection forces are developed is of no particular consequence to the inventor herein except insofar as manufacturing cost, simplicity and ease of use are always considerations to be borne in mind.

Turning now to FIGS. 1-4, in which like elements are denoted by like reference numerals, a first illustrative embodiment of a toy water gun amusement device 10 in accordance with the present invention is depicted. The depicted embodiment includes a generally gun-shaped (e.g., pistol, rifle or the like) body 12 having a handle portion 14 and a barrel portion 16. The device 10 includes a suitable trigger mechanism assembly 18 for actuating the gun, and a nozzle translation assembly 20 for emitting a stream of liquid.

As best seen in FIG. 1, device 10 further includes a water or liquid receiving and/or containing pressurization reservoir or chamber 24 defining a threaded fill opening 25 and having a threaded fill cap 26. Device 10 also includes a conduit 21 defining a discharge opening 23 adapted to establish fluid communication between chamber 24 and nozzle translation assembly 20. A fluid transfer system generally indicated at 22 is adapted to develop forces for causing a stream of liquid to flow through conduit 23 and out of the discharge orifice upon actuation of trigger mechanism 18. In the illustrative embodiment depicted in FIG. 1, fluid transfer system consists of a conventional, manually operated pump adapted to pressurize the contents of chamber 24 with air. An exemplary type of pump which may be used is shown and described in U.S. Pat. No. 6,474,507 issued on Nov. 5, 2002 to Hornsby et al., the disclosure of the same being expressly incorporated herein in its entirety.

The Hornsby et al. structure depicted in the embodiment of FIG. 1 is especially advantageous in that it is a double acting mechanism—pressurized air is delivered into chamber 24 is delivered whether pump handle portion 22*a* is moved in the forward or rearward direction. Alternatively, fluid transfer system 22 may be configured as a motorized pump operative to pressurize chamber 24 with air or to supply intermittent pulses of water to discharge opening 23. By way of still further example, a water gun constructed in accordance with the present invention may incorporate a manual liquid transfer pump utilizing a rotating crank that includes a graspable handle. Such water guns, although they lack a trigger mechanism and require the user to continually rotate the crank during use, have enjoyed considerable success in the market. As the crank is rotated, the manual liquid transfer pump causes liquid to be withdrawn from a chamber, as chamber 24, and forces this liquid to exit a nozzle opening at the forward end of the gun. It suffices to say that various pumping arrangements are suitable so long as suitable forces can be developed to initiate and/or sustain the flow of liquid to nozzle translation assembly 20 for the desired interval of time.

As noted earlier, some embodiments of the present invention may have more than one chamber (not shown), in which case one such chamber may be a water-receiving, fixed volume fill chamber as chamber 24, and the other chamber may be a water-pressurizable bladder (not shown) or a fixed-volume, air-pressurizable, chamber (not shown) adapted to receive both water from the fill chamber and pressurized air. Thus, by way of yet another example, fluid transfer system 22 may be configured as a manually operable, water transfer pump (not shown) adapted to transfer water from a first, fixed volume chamber into a second, expandable bladder-type chamber. In the embodiment depicted in FIG. 1, removable fill cap 26 includes a one-way valve 27 and is dimensioned and arranged to receive a hose end, quick-fill fitting adapter (not shown) so that water under pressure may be directed into chamber 24, according to the teachings of the aforementioned U.S. Pat. No. 6,234,347. When a source of municipally pressurized water is not available, fill cap 26 is removed and water is poured directly into the chamber. Extending from within chamber 24 is a conventional purge valve assembly 29. The function of the purge valve assembly 29 is to relieve excess pressure by venting pressurized air and/or water when the pressure exceeds a selected point.

With continued reference to FIG. 1, it will be seen that the body 12 of amusement device 10 is generally hollow and is adapted to support and/or contain trigger mechanism 18, nozzle translation assembly 20 and fluid transfer system 22. Additionally, body 12 provides a housing for other conventional operational components, including liquid-conducting conduits and chambers, as chamber 24, for containing a liquid such as water. The illustrative embodiment of the present invention depicted in FIG. 1 employs a trigger and valve assembly 18 of the type shown and described in the aforementioned U.S. Pat. No. 6,474,507. The trigger assembly 18 constitutes a generally water or liquid tight valve or flow control mechanism or structure operable to actuate and control a stream or "shot" of water. In addition to a valve assembly disposed within the liquid flow path defined by conduit 21, trigger mechanism assembly 18 includes a trigger 18*a*, a trigger linkage assembly consisting of pivotable linkage members 18*b* and 18*c*, and a spring 18*d* for resiliently biasing linkage member 18*c* (and thereby linkage member 18*b* and trigger 18*a*) into an initial position of rest. As trigger 18*a* is depressed, linkage member 18*b* is pulled rearwardly, urging linkage member 18*c* against valve pin 18*e*. This movement unseats the valve body and causes pressurized water stored within chamber 24 to flow into and through conduit 21 toward rotatable nozzle translation assembly 20.

It will be recalled that nozzle translation assembly 22 is dimensioned and arranged to rotate so that while trigger 18*a* is depressed, the stream of water being discharged through discharge orifice 32 defined by the element indicated generally at element 34, traverses a circular path relative to the longitudinal axis of the barrel portion, handle, or other housing structure, while the housing structure itself remains stationary. The stream thus discharged has a helical or spiral configuration, which is unbroken for so long as the trigger is depressed and water is flowing through conduit 21.

Automatic rotation of nozzle translation assembly 20 to produce a helical or spiral discharge effect can be achieved in a variety of ways. By way of illustrative example, an illustrative nozzle translation assembly constructed in accordance with this embodiment of the invention may include a motorized drive assembly (not shown) responsive to depression of the trigger or, alternatively, to actuation of an on/off selector switch, and drivingly engageable with appropriate gearing coupled to nozzle translation assembly 20. By way of alternate example, discharge orifice 32 of nozzle translation assembly 20 may be dimensioned and arranged to impart a nozzle reaction force—that is offset relative to the axis of nozzle translation assembly rotation—as the stream of water is discharged. Even a relatively small angle of inclination of the discharge stream relative to a plane orthogonal to the rotational axis of the nozzle translation assembly is sufficient to induce rotation of the nozzle translation assembly. It should also be noted that triggerless structures are also contemplated by the inventor herein. For example, in a water gun employing a manually rotated crank to operate a liquid transfer pump, the rotating crank shaft can also be used to drive appropriate gearing for rotating nozzle translation assembly 20 at the same time. Other forms of triggerless operation contemplated include a voice actuation circuit responsive to speech signals, input by microphone, to operate a solenoid valve or other suitable structure disposed along the fluid communication path defined by conduit 21.

Figure 2:
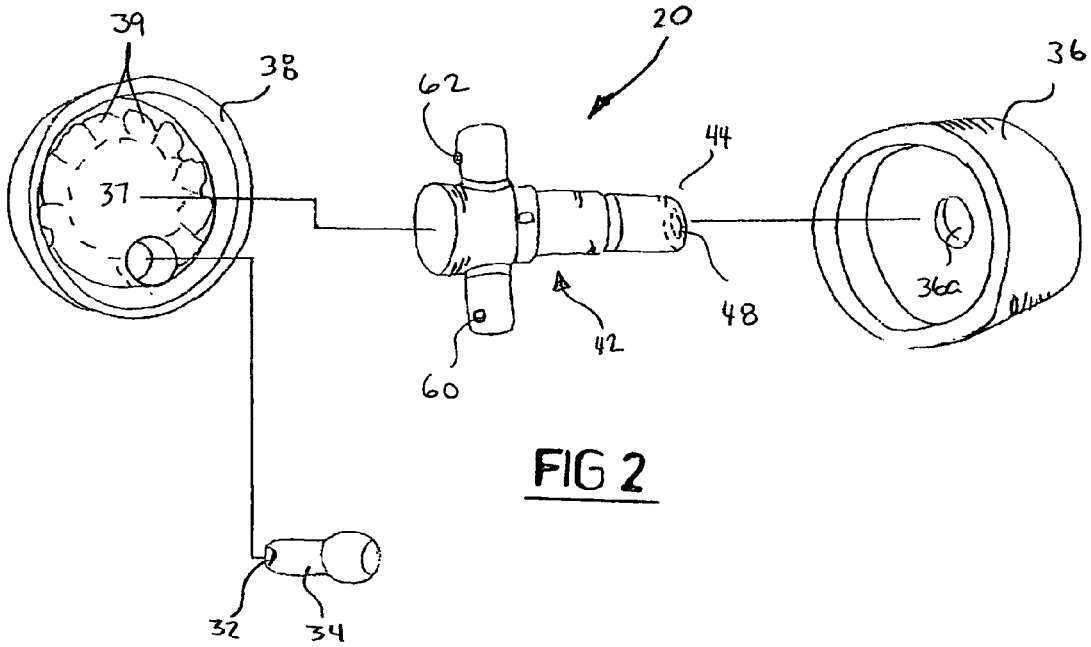
FIG. 2 is broken apart, perspective view depicting the internal construction of an exemplary, nozzle translation assembly for use in realizing the illustrative embodiment of FIG. 1.
Figure 3:
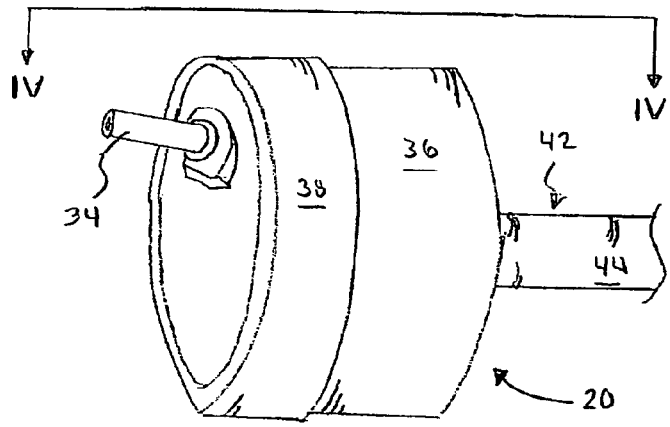
FIG. 3 is a perspective view depicting final assembly of the exemplary rotating nozzle translation assembly of FIG. 2.
Figure 4:
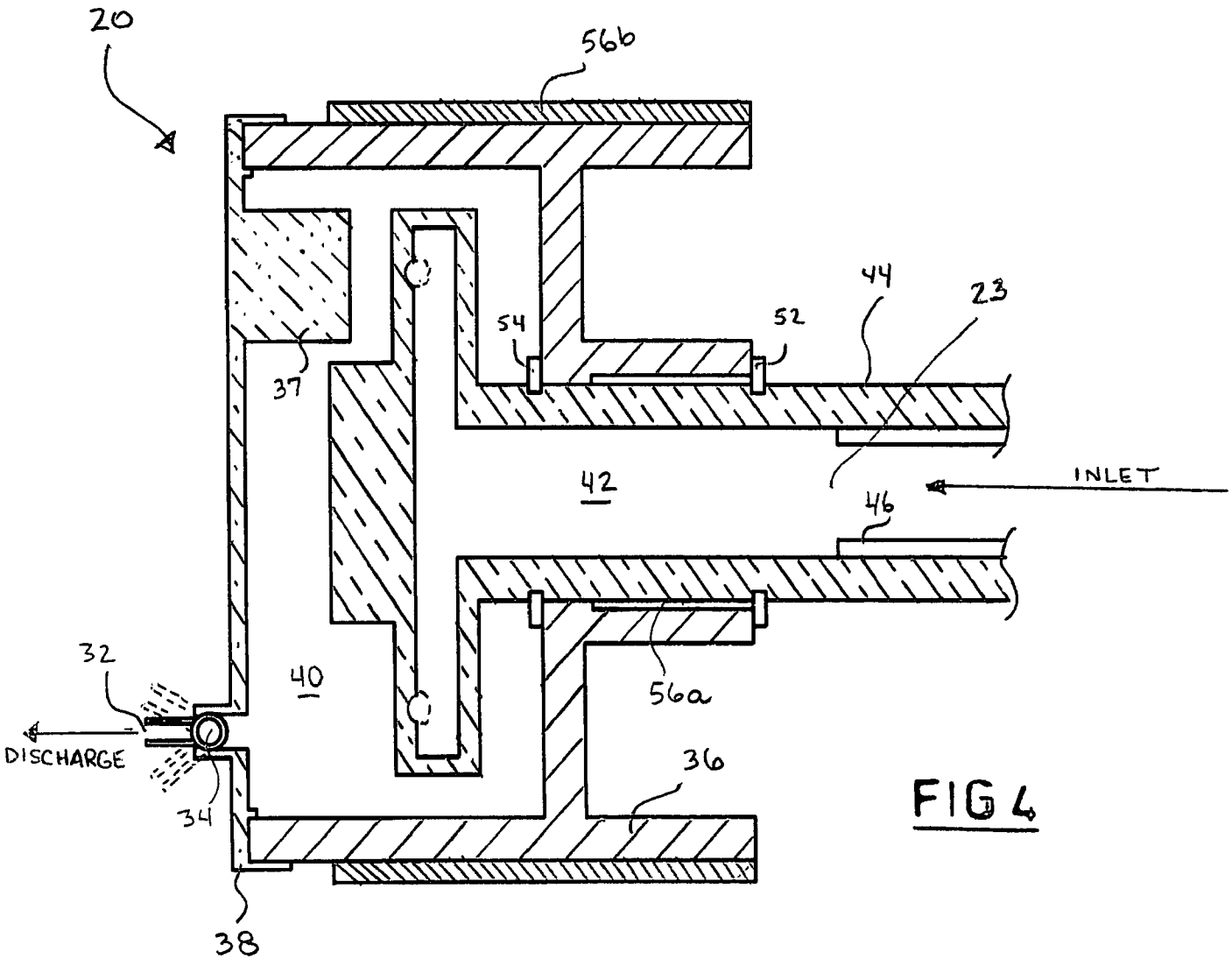
FIG. 4 is a cross sectional view of the exemplary rotating nozzle translation assembly of FIGS. 2 and 3, taken across the plane IV-IV depicted in FIG. 3.

In accordance with an especially preferred embodiment of the present invention, however, the force for spinning nozzle translation assembly 20 is provided via the pressurized water stream traversing conduit 21. An exemplary structure adapted to utilize this force is depicted in FIGS. 2-4 and will now be described in detail. As seen in FIG. 2, nozzle translation assembly 20 comprises a first section 36 and a second section 38 which, when assembled into the configuration shown in FIGS. 3 and 4, define an interior cavity 40 (FIG. 4) within which is disposed a flow diverter assembly indicated generally at 42.

With reference to both FIGS. 2 and 4, it will be seen that flow diverter assembly 42 has a proximal end 44 dimensioned and arranged to receive and retain the distal end 46 of conduit 21. Conduit 21 and flow diverter assembly 42 are fastened together in a conventional manner such, for example, as by a suitable adhesive. As such, fluid diverter assembly 42 is not a moving part but, rather, is stationary despite being disposed within interior cavity 40. Fluid exiting the discharge orifice 23 of conduit 21 enters an inlet 48 defined at the proximal end 44 of flow diverter assembly 42. The center of first section 36 defines an axial opening through which proximal end 44 is inserted. Locking rings indicated generally at 52 and 54 in FIG. 4 prevent axial movement of diverter assembly 42 relative to first section 38. A first bushing indicated generally at 56*a* enables first section to rotate about an axis defined by flow diverter assembly 42. To prevent water from leaking out of interior cavity 40, O-rings or other suitable gaskets may be utilized at the interface between the interior surface of bore 36*a* of first section 36 and the exterior surface of diverter assembly 42. A second bushing, indicated generally at 56*b* is provided to retain and support nozzle translation assembly 20 within body 12 of water gun 10 while still allowing it to freely rotate.

Defined within the interior axial surface 37 of second section 38 are a plurality of vanes 39. As best seen in FIG. 2, liquid entering inlet opening 48 of flow diverter assembly 42 exits via a pair of exit openings indicated generally at 60 and 62. As will be readily appreciated by those skilled in the art, exit opening 60 and 62 are dimensioned and arranged so as to cause corresponding jets of liquid to impinge upon the surfaces of vanes 39, thereby initiating rotation of first section 36 and second section 38.

In the illustrative embodiment depicted in FIGS. 1-4, it will be seen that water exits the spinning nozzle translation assembly 20 via a pivotably movable nozzle member 34. Such a structure is advantageous in that it gives the user a high degree of flexibility in defining the diameter and/or pitch of the helical stream which is discharged. Of course, if such flexibility is not a design constraint, then it is of course possible to integrally form a nozzle member directly as part of second section 38. In that regard, it is contemplated that a nozzle member so constructed may be configured to extend forward at any desired angle relative to the axis of rotation of rotatable nozzle translation assembly 20. It is further contemplated that multiple nozzle members may be included so as to cause to simultaneous streams to be helically wound about the axis of nozzle translation assembly rotation.

Figure 5:
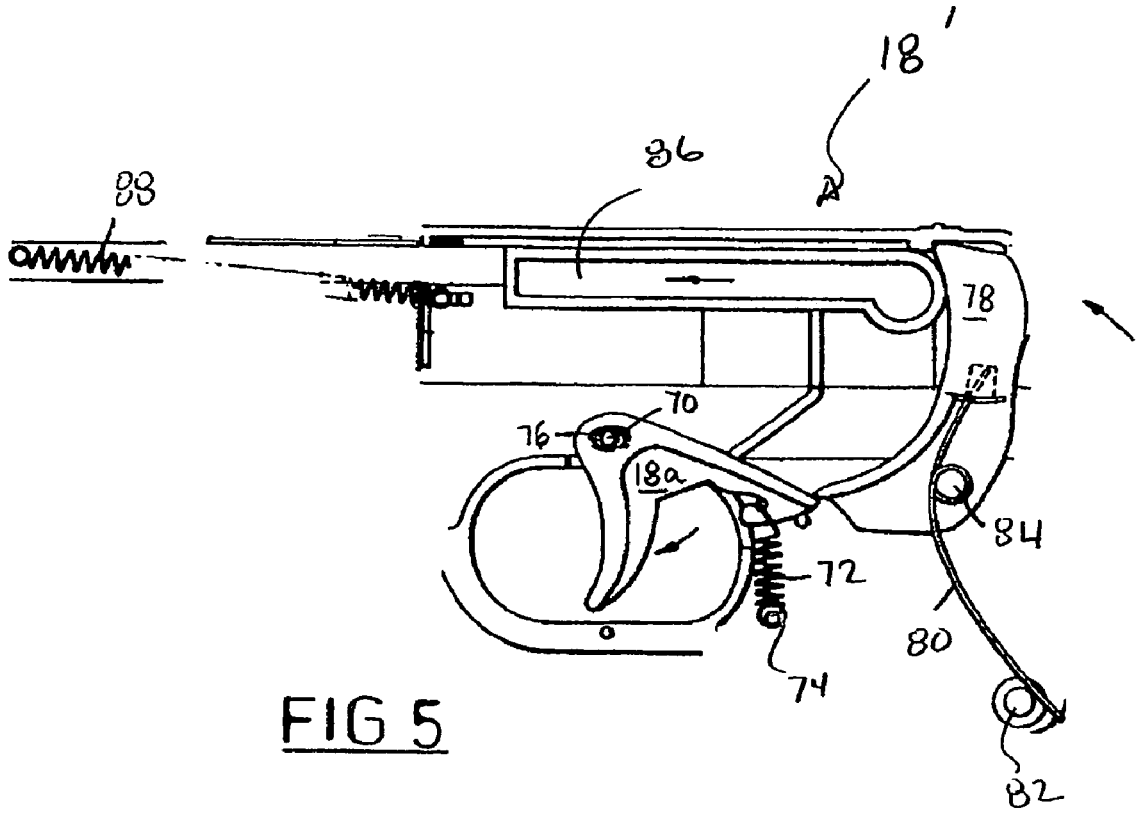
FIGS. 5 and 6 are respective side elevation views of an illustrative embodiment of a dual mode trigger mechanism, the trigger mechanism being manipulable into a first operative position wherein a continuous flow through the nozzle translation assembly is initiated and maintained and into a second or "pulsing" position wherein only a brief (on the order of several seconds or so) discharge through the nozzle translation assembly is sustained.
Figure 6:
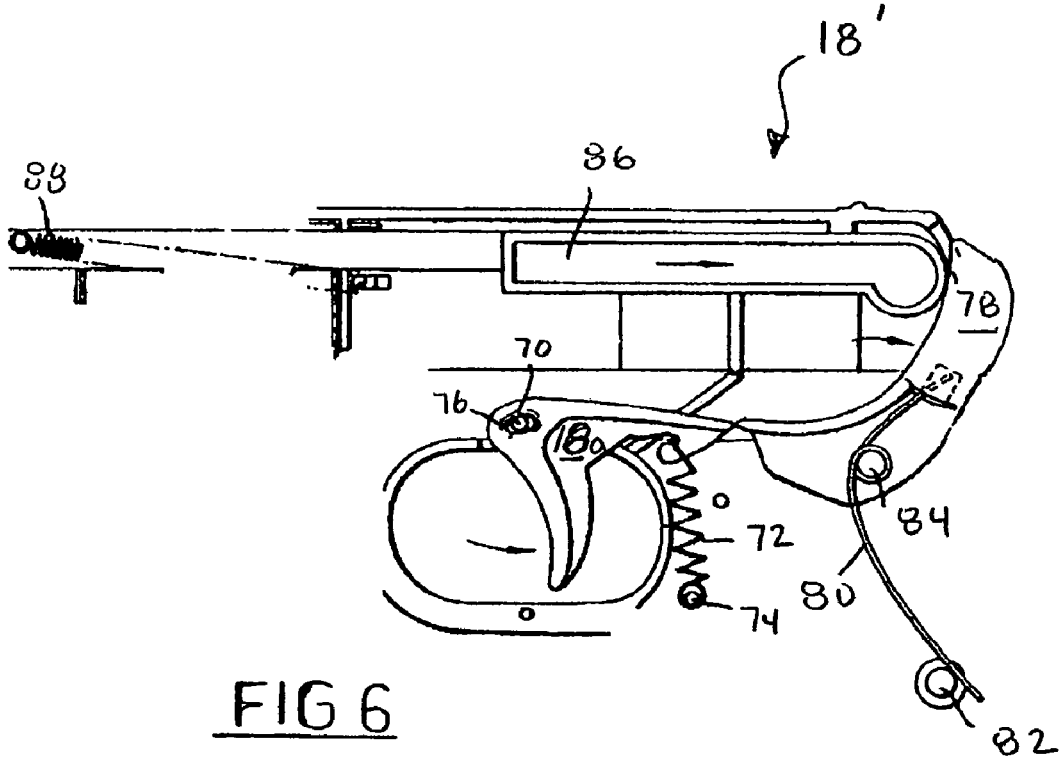

Turning now to FIGS. 5 and 6, there is disclosed an alternate trigger mechanism 18' operative in a first mode, during which liquid flows continuously from spinning nozzle translation assembly 20 for so long as trigger 18*a*' is maintained in a first position and in a second mode, in which a short burst of liquid flows when the trigger is depressed into a second position, to thereby form a truncated helical stream reminiscent of a tornado. The trigger mechanism described herein is suitable for use with any of the embodiments disclosed and/or described in detail herein. It should be noted, however, that the valve structures employed in the various depicted embodiments (including the embodiment of FIGS. 1-4) rely upon rearward motion of the valve pin and body as the trigger is depressed, and the trigger mechanism of FIGS. 5 and 6 are also designed to produce rearward motion of the valve pin and body as the trigger is depressed. To the extent a forward motion of the valve pin and body are needed, it is believed by the inventor herein that the rearrangement of parts within the fluid communication path so as to reverse the direction of valve movement is well within the level of skill of the ordinary artisan.

Pivotable trigger member 18*a*' is mounted on a lug 70 and is resiliently urged forward by a return spring 72 attached to trigger member 18*a*' and to a second lug 74. It will be noted that mounting aperture 76 in the trigger member 18*a*' is elongate so as to permit the longitudinal movement of trigger member 18*a*' to recock the trigger. Acting on by the trigger member 18*a*' is a pivotable camming member 78 resiliently urged in the anticlockwise direction by a strong spring 80 engaged over lug 82 and with camming member 78 and also with lug 84. It will be seen that when trigger 18*a*' is pulled, it engages with camming member 78 and urges it in a clockwise direction against the force of spring 80 until toward the end of its travel trigger member 18*a*' slips off the end of camming member 78 which thereupon rapidly returns to its original position under spring action.

Associated with camming member 78 is a longitudinally movable slide member 86 mounted for linear movement to thereby provide the motive force for urging a valve disposed along the fluid communication path defined by conduit 24 into an open position permitting flow. A spring 88 connected between the end of slide member 86 and the housing draws slide member 86 back when camming member 78 is drawn back. In FIG. 6, camming member 78 is in a first position, corresponding to a "continuous stream mode of operation" during which the valve assembly (not shown) connected to movable slide member 86 is open. For a "pulsed stream mode of operation", the trigger mechanism is squeezed quickly, such that camming member 78 is, in a very brief time, released from its engagement with sliding member 86—rapidly urging slide member 86 (and the valve assembly to which it is linked) back quickly into the off position.

Figure 7A:
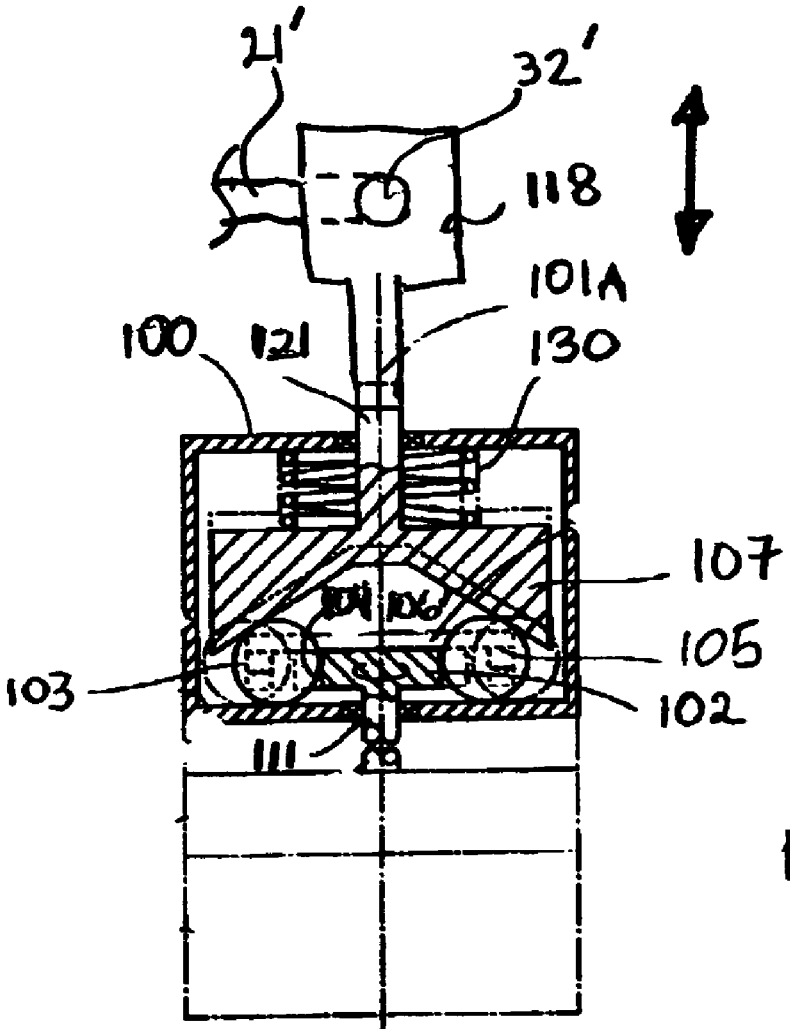
FIGS. 7A and 7B are cross sectional views depicting the internal construction of a nozzle translation assembly adapted to move the discharge orifice along a predefined, non-circular path in accordance with a modified embodiment of the present invention.
Figure 7B:
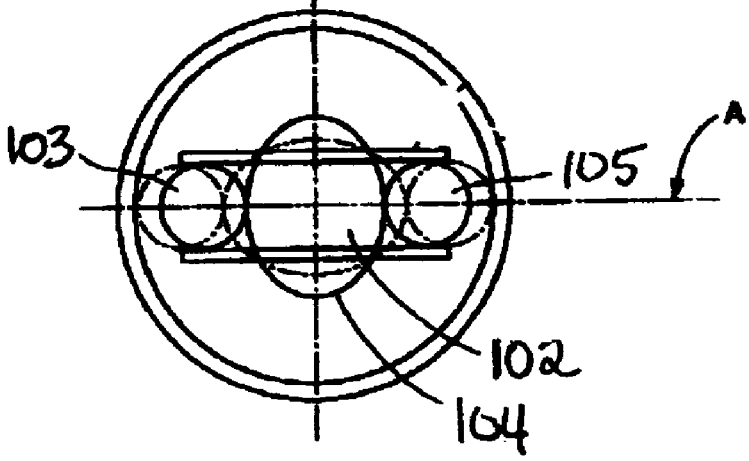
Figure 8:
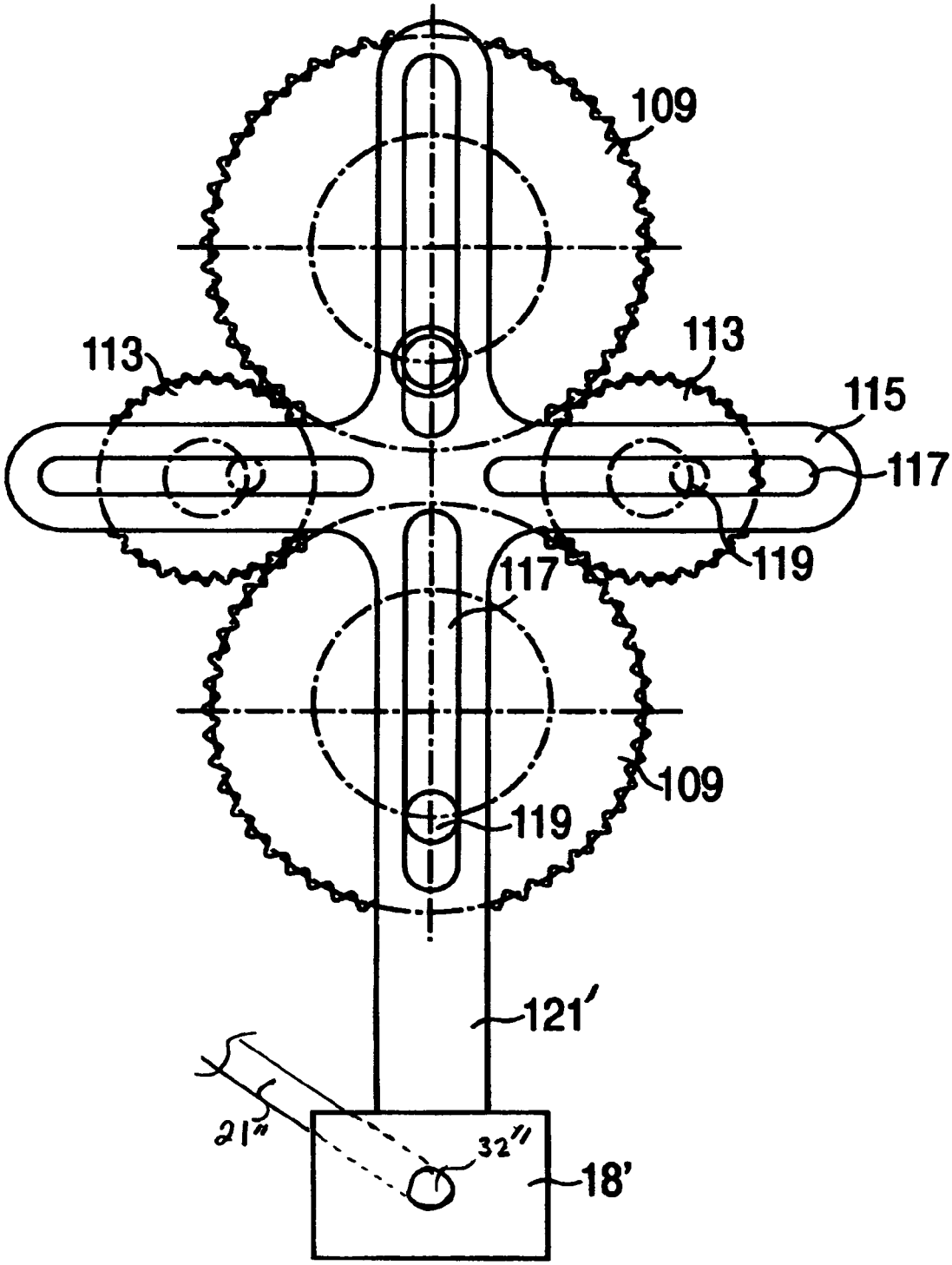
FIG. 8 is a plan view depicting the internal construction of a nozzle translation assembly adapted to move the discharge orifice along a predefined, non-circular path in accordance with yet another modified embodiment of the present invention.

FIGS. 7A-8 depict alternate embodiments of the present invention in which non-circular movements of the nozzle discharge orifice, relative to the water gun housing, are achieved. Whereas the embodiment of FIGS. 1-4 may be characterized as approximating a "cyclone" or "twister" discharge configuration, the embodiment of FIGS. 7A and 7B is intended to achieve a "zig-zag" configuration. To that end, the nozzle translation assembly utilized in the illustrative embodiment of FIGS. 7A and 7B utilizes a mechanism 100 that includes a first cam 102 having an elliptical profile (FIG. 7B) and a peripheral cam face 104. As first cam 102 rotates, a pair of spherical members 103, 105 in contact with cam face 104 move in the radial direction. A conical cam face 106 of a second cam 107 is pressed against each spherical member 103, 105 by a pre-load spring 130. As such, the second cam 107 performs reciprocating linear movement in the direction of a central axis of rotation 101A when each spherical member 103, 105 moves in the radial direction. Thus, rotary movement of a rotary input shaft 111 connected to first cam 102 is converted into linear reciprocating movement of an output rod or extension 121 connected with second cam 107. A mounting member 118 on extension 121 receives the terminal end of a fluid conduit 21' that receives water under pressure from the water gun reservoir, the fluid conduit terminating at discharge orifice 32'. As will be readily appreciated by those skilled in the art, the gears of the rotary translation assembly of FIGS. 7A and 7B may be driven by a conventional electrical motor (not shown) or by a conventional water turbine (not shown). In the latter case, water exiting the water turbine chamber (not shown) is supplied by conduit 21' to discharge orifice 32'. In any event, it will be readily ascertained by those skilled in the art that as mounting member 118 moves back and forth, so does discharge orifice 32'. The result is a stream of liquid that moves side to side (or up and down, as the case may be) while the trigger mechanism is actuated, all without the need for the user to move the water gun housing.

FIG. 8 is intended to depict a nozzle translation assembly which achieves a "figure eight" flow pattern and, like the embodiment of FIGS. 7A and 7B, employs a conventional mechanism for moving the discharge opening along the figure eight path. The well known mechanism depicted in FIG. 8 comprises a pair of larger gears 109, each of which is meshed alternatively with each of a pair of smaller gears 113 with a gear ratio of 2:1. A truss 115 is formed of four orthogonal arms, each arm having a slot 117 defined therein. A pin 119 off center in each gear slides in a corresponding slot so that an extension 121' of one arm moves in a figure eight when the gears are rotated. A mounting member 18' on the extension receives the terminal end of a fluid conduit 21" that receives water under pressure from the water gun reservoir, the fluid conduit terminating at discharge orifice 32". As will be readily appreciated by those skilled in the art, the gears of the rotary translation assembly of FIG. 8 may be driven by a conventional electrical motor (not shown) or by a conventional water turbine (not shown). In the latter case, water exiting the water turbine chamber (not shown) is supplied by conduit 21" to discharge orifice 32". The result is a stream of liquid that traverses a figure eight path for so long as the trigger mechanism is actuated, all without the need for the user to move the water gun housing.

It should be emphasized that although three illustrative paths—along which the discharge orifice of a water gun may be configured to move—have been illustrated and described herein in detail in the foregoing description, it is deemed to be within the level of skill of the ordinary artisan to devise a variety of alternate nozzle translation mechanisms capable of causing the discharge orifice to traverse an array of such paths as, for example, cardiod, elliptical, ellispsoid, ovoid, etc. Thus, while the particular water guns as herein shown and described in detail are fully capable of attaining the above-described objects of the invention, it is to be understood that they are merely illustrative embodiments of the present invention and are thus merely representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A toy water gun comprising:

a housing having a front end and a rear end;

a reservoir supported by said housing for containing a liquid;

a nozzle defining a discharge orifice proximate said front end;

an avenue of release for establishing fluid communication between said reservoir and said discharge orifice, the avenue of release including a conduit;

a valve arranged in said avenue of release and comprising a valve seat and a valve body, said valve selectively opening and closing said avenue of release;

a trigger operatively connected to said valve body to unseat said valve body from said valve seat to open said valve upon actuation of said trigger;

a fluid transfer system operative to develop forces to said reservoir for causing a stream of liquid to flow through said avenue of release and out of said discharge orifice upon actuation of said trigger, wherein said fluid transfer system operates separately from the actuation of said trigger to develop the forces in said reservoir; and a nozzle translation assembly dimensioned and arranged to move said discharge orifice, relative to said housing, along a predefined path during the actuation of said trigger to thereby cause liquid to be discharged in an unbroken stream along a time varying path without requiring movement of the toy water gun;

wherein a first section of said nozzle translation assembly is adapted to rotate about an axis of rotation passing through said front end and rear end of said housing to move said discharge orifice along a circular path to thereby create an unbroken spiral or helical stream of liquid during operation of said trigger, and wherein said nozzle translation assembly has a cup-shaped portion formed by an end wall with an interior axial surface and a circumferential wall, said end wall and circumferential wall forming sides of an interior cavity in communication with said conduit so that liquid exiting said conduit enters and fills said interior cavity.

2. The toy water gun of claim 1, wherein said nozzle translation assembly is driven to rotate said discharge orifice by one of a motorized drive assembly and energy imparted by moving liquid.

3. The toy water gun of claim 1, wherein said nozzle translation assembly is driven to rotate said discharge orifice by a nozzle reaction force as the stream of water is discharged from said discharge orifice.

* * * * *

UNITED STATES PATENT AND TRADEMARK OFFICE

CERTIFICATE OF CORRECTION

PATENT NO. : 7,837,067 B2
APPLICATION NO. : 11/271613
DATED : November 23, 2010
INVENTOR(S) : Alan Amron It is certified that error appears in the above-identified patent and that said Letters Patent is hereby corrected as shown below:

On the title page, item (73) should read:

(73) Assignee: Thought Development, Inc., Miami Beach, FL (US)

Signed and Sealed this
Eighth Day of March, 2011

David J. Kappos

David J. Kappos
*Director of the United States Patent and Trademark Office*